US007182149B2

(12) United States Patent
Chang

(10) Patent No.: US 7,182,149 B2
(45) **Date of Patent: *Feb. 27, 2007**

(54) PNEUMATIC WRENCH HAVING REINFORCED STRENGTH

(76) Inventor: Hsin Ho Chang, No.283, Guangfu Rd., Situn District, Taichung City (TW) 407

( * ) Notice: Subject to any disclaimer, the term of this patent is extended or adjusted under 35 U.S.C. 154(b) by 83 days.

This patent is subject to a terminal disclaimer.

(21) Appl. No.: 10/916,568

(22) Filed: Aug. 11, 2004

(65) Prior Publication Data

US 2006/0032646 A1 Feb. 16, 2006

(51) Int. Cl.
*B25D 15/00* (2006.01)

(52) U.S. Cl. ..... 173/93.5; 173/93; 173/93.6; 173/104; 173/125; 173/126

(58) Field of Classification Search ..... 173/93, 173/93.5, 109, 93.6, 125, 126; 81/465, 466
See application file for complete search history.

(56) References Cited

U.S. PATENT DOCUMENTS 2,580,631 A * 1/1952 Whitledge ..... 173/93.5
2,802,556 A * 8/1957 Schmid ..... 173/93.5
3,533,479 A * 10/1970 Albertson et al. ..... 173/93.5
3,661,217 A * 5/1972 Maurer ..... 173/93.5
4,287,956 A * 9/1981 Maurer ..... 173/93.5
4,321,973 A * 3/1982 Maurer ..... 173/93.5
6,024,180 A * 2/2000 Lin ..... 173/93.5
6,070,674 A * 6/2000 Williamson et al. ..... 173/1
6,454,020 B1 * 9/2002 Jong ..... 173/93
6,491,111 B1 * 12/2002 Livingston et al. ..... 173/93.5
2006/0011364 A1 * 1/2006 Chang ..... 173/93.5

* cited by examiner

*Primary Examiner*—John Sipos
*Assistant Examiner*—Michelle Lopez
(74) *Attorney, Agent, or Firm*—Bacon & Thomas, PLLC

(57) ABSTRACT

A pneumatic wrench includes a pneumatic motor, a striking portion, and a drive shaft. The striking portion includes a support seat, a first pin, a second pin, a first hammer, and a second hammer. Thus, the locking strip of the first hammer and the locking strip of the second hammer increase the thickness of the first hammer and the second hammer respectively to reinforce the structural strength of the first hammer and the second hammer, thereby preventing the first hammer and the second hammer from being broken due to vibration so as to increase the lifetime of the first hammer and the second hammer.

13 Claims, 6 Drawing Sheets

PNEUMATIC WRENCH HAVING REINFORCED STRENGTH

BACKGROUND OF THE INVENTION

1. Field of the Invention

The present invention relates to a pneumatic wrench, and more particularly to a pneumatic wrench having a reinforced structural strength to withstand a larger torque.

2. Description of the Related Art

A conventional pneumatic wrench in accordance with the prior art shown in FIGS. 4–6 comprises a pneumatic motor 10, a striking portion 20, and a drive shaft 30. The striking portion 20 is driven by the pneumatic motor 10 to rotate in the normal direction and the reverse direction to drive the drive shaft 30 to rotate, so that the drive shaft 30 is rotated to rotate a socket (not shown) mounted on the drive shaft 30 so as to drive and rotate a screw member, such as a bolt, nut or the like.

The pneumatic motor 10 includes a cylinder 11, a vane 12 mounted in the cylinder 11, a rotor 15 mounted in the cylinder 11, and a toothed shaft 16 mounted on and protruded outward from the rotor 15. The striking portion 20 includes a support seat 21 having a first end face formed with a toothed hole 22 engaged with the toothed shaft 16 of the pneumatic motor 10 and a second end face formed with a through hole 23 for mounting the drive shaft 30, a first hammer 26 mounted in the support seat 21, and a second hammer 28 mounted in the support seat 21. The support seat 21 of the striking portion 20 has two opposite side walls formed with two mounting holes 24 for mounting two pins 25. The first hammer 26 and the second hammer 28 are fixed in the support seat 21 by the pins 25. Thus, the first hammer 26 and the second hammer 28 are driven by the pins 25. In addition, the first hammer 26 is formed with a first locking hole 27, and the second hammer 28 is formed with a second locking hole 29 located opposite to the first locking hole 27, so that the first hammer 26 and the second hammer 28 co-operate to drive the drive shaft 30 to rotate in the normal direction and the reverse direction. The drive shaft 30 has a first end mounted in the support seat 21 of the striking portion 20 and formed with an engaging portion 35 engaged with the first hammer 26 and the second hammer 28 and a second end formed with a mounting portion 31 for mounting the socket. The engaging portion 35 of the drive shaft 30 has a first end formed with a first driven block 36 mounted in the first locking hole 27 of the first hammer 26 and a second end formed with a second driven block 37 mounted in the second locking hole 29 of the second hammer 28.

In operation, after the compressed air enters the cylinder 11 of the pneumatic motor 10, the vane 12 and the rotor 15 are operated to rotate the toothed shaft 16 which rotates the support seat 21, so that the support seat 21 of the striking portion 20 is rotated in the normal direction and the reverse direction to move the pins 25 to move the first hammer 26 and the second hammer 28 which are driven to strike the first driven block 36 and the second driven block 37 of the drive shaft 30 respectively, so as to drive the drive shaft 30 to rotate. Thus, the drive shaft 30 is rotated to rotate the socket mounted on the mounting portion 31 of the drive shaft 30 so as to drive and rotate a screw member, such as a bolt, nut or the like.

However, both of the first hammer 26 and the second hammer 28 which are driven by the pins 25, so that the pins 25 are easily worn out or broken due to a stress concentration, thereby decreasing the lifetime of the conventional pneumatic wrench. In addition, the first hammer 26 is formed with two openings 260 mounted on the pins 25, and the second hammer 28 is formed with two openings 280 mounted on the pins 25, thereby reducing the thickness of each of the first hammer 26 and the second hammer 28, so that the first hammer 26 and the second hammer 28 are easily worn or broken due to vibration. Further, each of the pins 25 is extended through the whole length of each of the two mounting holes 24 of the support seat 21, so that each of the pins 25 has a greater length and is easily bent or broken due to a bending action.

SUMMARY OF THE INVENTION

The primary objective of the present invention is to provide a pneumatic wrench having a reinforced structural strength to withstand a larger torque.

Another objective of the present invention is to provide a pneumatic wrench, wherein the locking strip of the first hammer and the locking strip of the second hammer increase the thickness of the first hammer and the second hammer respectively to reinforce the structural strength of the first hammer and the second hammer, thereby preventing the first hammer and the second hammer from being broken due to vibration so as to increase the lifetime of the first hammer and the second hammer.

A further objective of the present invention is to provide a pneumatic wrench, wherein the first pin is used to drive the first hammer and the second pin is used to drive the second hammer respectively, so that each of the first pin and the second pin has a smaller length to increase the structural strength of the first pin and the second pin, thereby preventing the first pin and the second pin from being broken due to a bending action so as to increase the lifetime of the first pin and the second pin.

In accordance with one embodiment of the present invention, there is provided a pneumatic wrench, comprising a striking portion including:

a support seat having a first side wall having an inner face formed with a first insertion hole for mounting a first pin and a second side wall having an inner face formed with a second insertion hole for mounting a second pin;

a first hammer mounted in the support seat and having a first side secured on the first pin and a second side formed with a locking strip inserted into and locked in the second insertion hole; and a second hammer mounted in the support seat having a first side secured on the second pin and a second side formed with a locking strip inserted into and locked in the first insertion hole.

Further benefits and advantages of the present invention will become apparent after a careful reading of the detailed description with appropriate reference to the accompanying drawings.

DETAILED DESCRIPTION OF THE INVENTION

Figure 1:
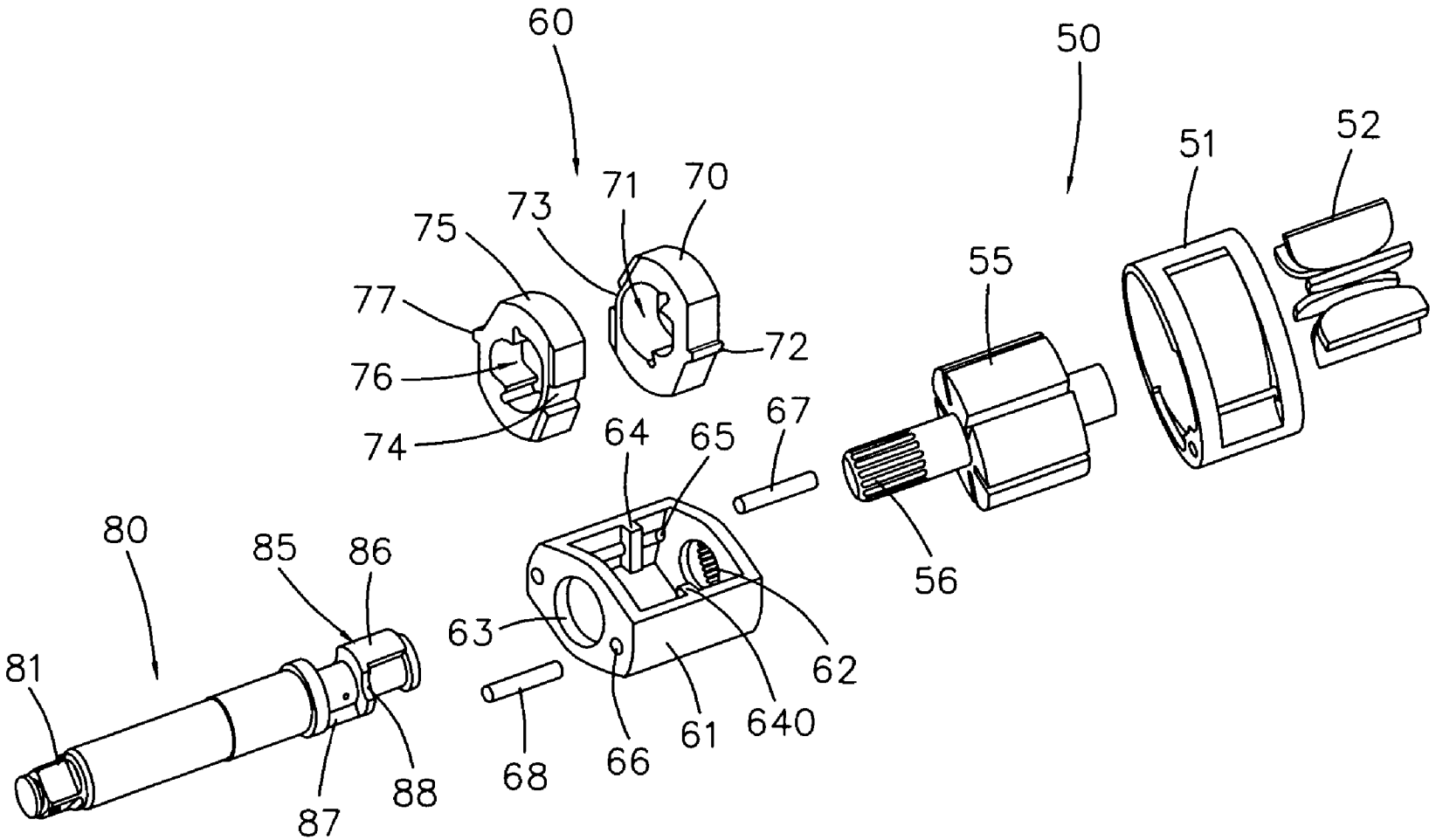
FIG. 1 is an exploded perspective view of a pneumatic wrench in accordance with the preferred embodiment of the present invention.
Figure 2:
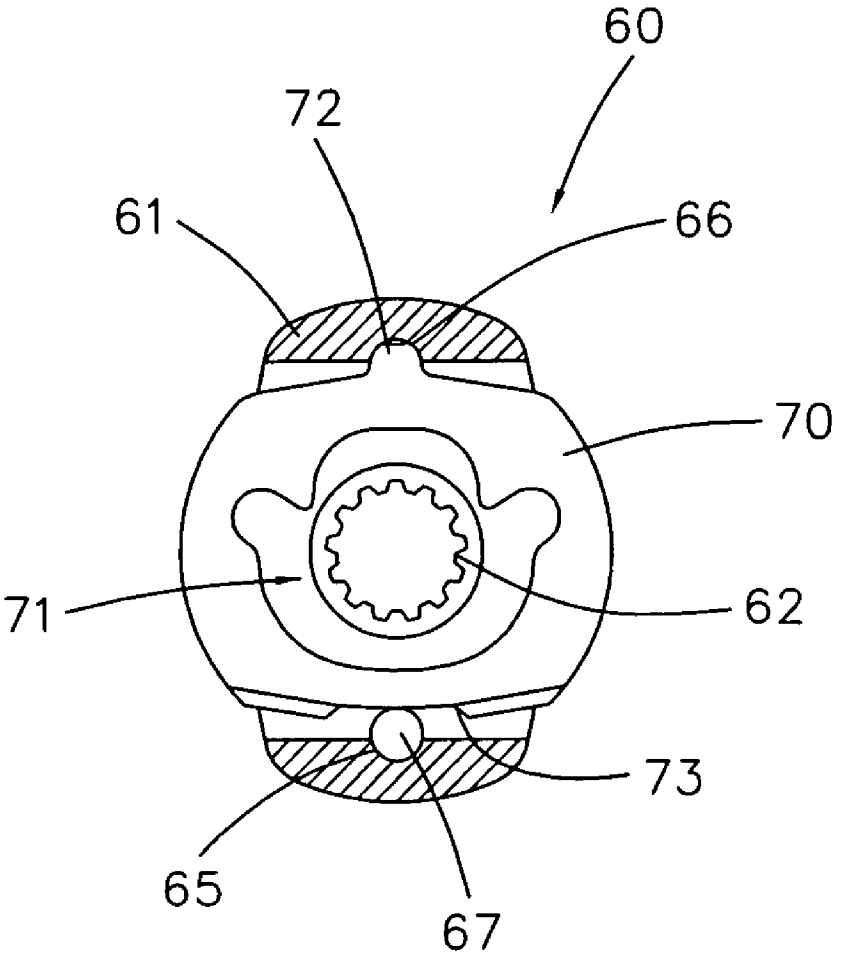
FIG. 2 is a plan cross-sectional assembly view of the pneumatic wrench as shown in FIG. 1.
Figure 3:
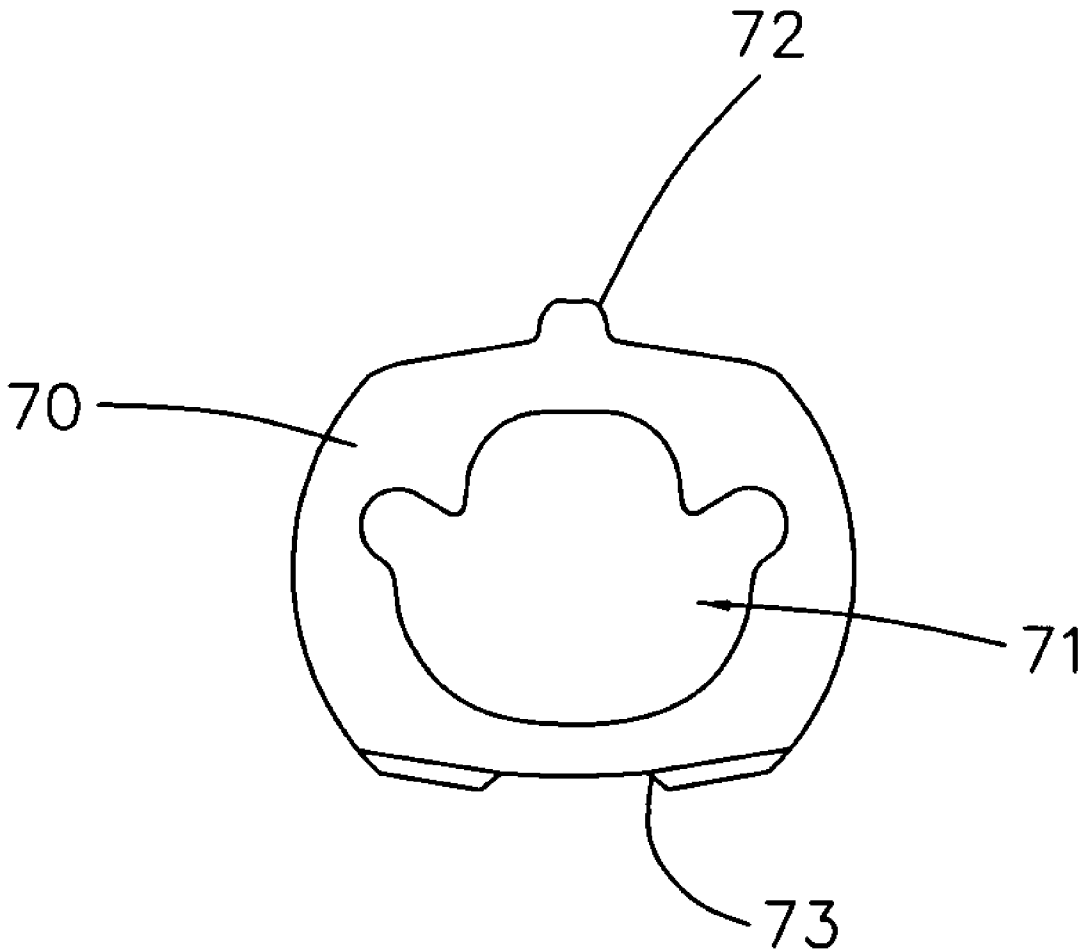
FIG. 3 is a plan view of a first hammer of the pneumatic wrench as shown in FIG. 2.
Figure 4:
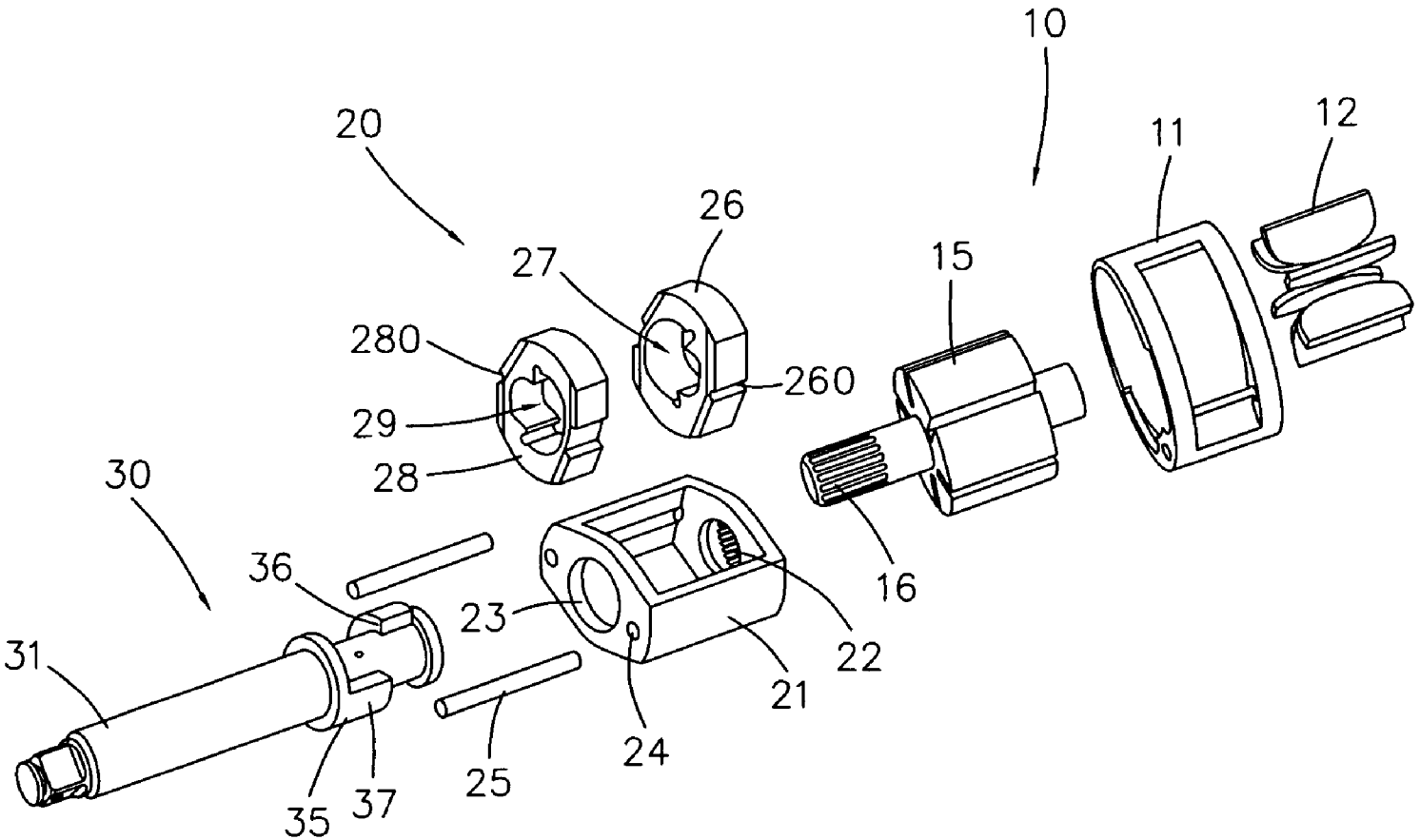
FIG. 4 PRIOR ART
FIG. 4 is an exploded perspective view of a conventional pneumatic wrench in accordance with the prior art.
Figure 5:
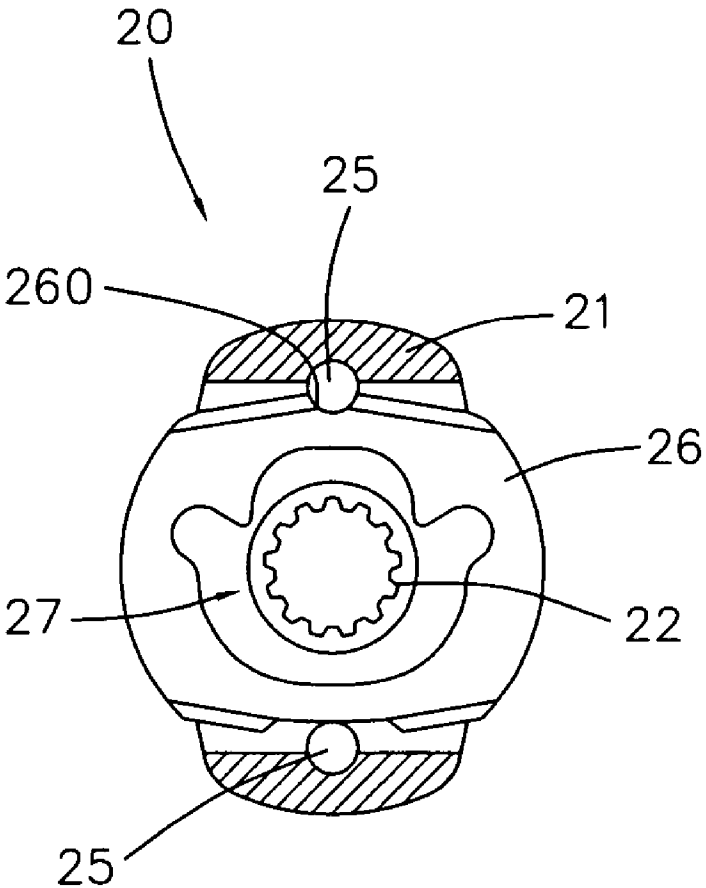
FIG. 5 PRIOR ART
FIG. 5 is a plan cross-sectional assembly view of the conventional pneumatic wrench as shown in FIG. 4.
Figure 6:
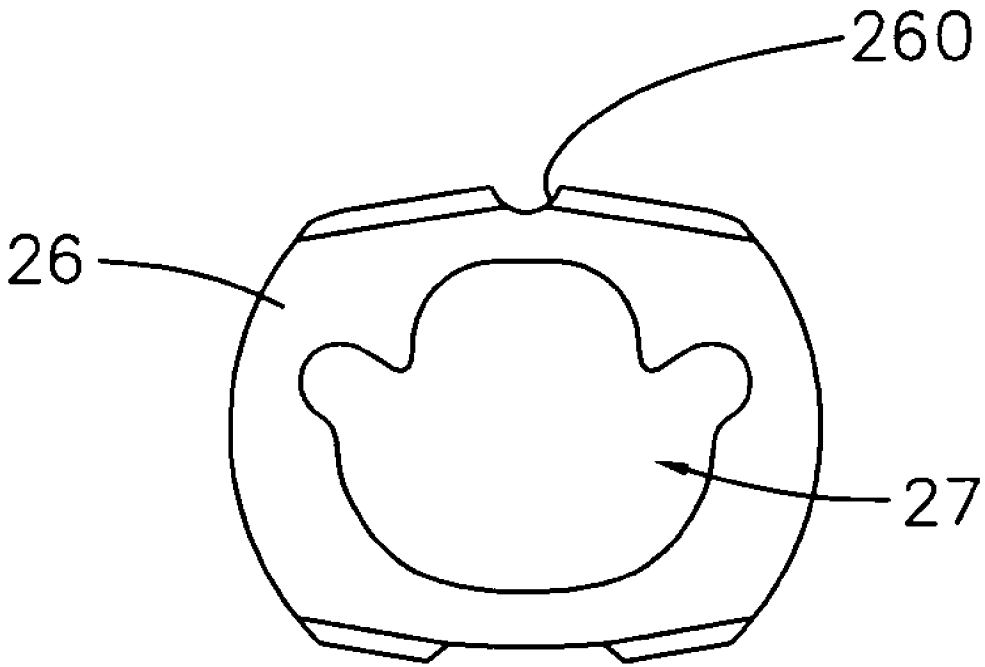
FIG.6 PRIOR ART
FIG. 6 is a plan view of a first hammer of the conventional pneumatic wrench as shown in FIG. 5.

Referring to FIGS. 1–3, a pneumatic wrench in accordance with the preferred embodiment of the present invention comprises a pneumatic motor 50, a striking portion 60, and a drive shaft 80. The drive shaft 80 is mounted on a socket (not shown), the striking portion 60 is mounted on the drive shaft 80, and the pneumatic motor 50 is mounted on the striking portion 60. Thus, the striking portion 60 is driven by the pneumatic motor 50 to rotate in the normal direction and the reverse direction to drive the drive shaft 80 to rotate, so that the drive shaft 80 is rotated to rotate the socket mounted on the drive shaft 80 so as to drive and rotate a screw member, such as a bolt, nut or the like.

The pneumatic motor 50 includes a cylinder 51, a vane 52 mounted in the cylinder 51, a rotor 55 mounted in the cylinder 51, and a toothed shaft 56 mounted on and protruded outward from the rotor 55.

The striking portion 60 includes a support seat 61 having a first end face formed with a toothed hole 62 engaged with the toothed shaft 56 of the pneumatic motor 50 and a second end face formed with a through hole 63 to allow passage of the drive shaft 80, a first hammer 70 mounted in the support seat 61, and a second hammer 75 mounted in the support seat 61. Preferably, the through hole 63 is co-axial with the toothed hole 62 of the support seat 61.

The support seat 61 of the striking portion 60 has a first side wall having an inner face formed with a first insertion hole 65 for mounting a first pin 67 and a second side wall having an inner face formed with a second insertion hole 66 for mounting a second pin 68. The first pin 67 and the second pin 68 are located diagonally opposite relative to each other.

The first insertion hole 65 of the support seat 61 has two distal ends extended through the first and second end faces of the support seat 61 respectively, and the second insertion hole 66 of the support seat 61 has two distal ends extended through the first and second end faces of the support seat 61 respectively.

The inner face of the first side wall of the support seat 61 has a mediate portion formed with a first spacer 64 mounted on the first pin 67, and the first insertion hole 65 is extended through the first spacer 64. The inner face of the second side wall of the support seat 61 has a mediate portion formed with a second spacer 640 mounted on the second pin 68, and the second insertion hole 66 is extended through the second spacer 640.

In addition, the first pin 67 is inserted into the first insertion hole 65 of the support seat 61 and limited by the first spacer 64 and the first end face of the support seat 61, and the second pin 68 is inserted into the second insertion hole 66 of the support seat 61 and limited by the second spacer 640 and the second end face of the support seat 61.

The first hammer 70 has a first side secured on the first pin 67 and a second side formed with a locking strip 72 inserted into and locked in the second insertion hole 66. The second hammer 75 has a first side secured on the second pin 68 and a second side formed with a locking strip 77 inserted into and locked in the first insertion hole 65. Preferably, the first side of the first hammer 70 is formed with a cavity 73 mounted on the first pin 67, and the first side of the second hammer 75 is formed with a cavity 74 mounted on the second pin 68. The first hammer 70 and the second hammer 75 are separated by the first spacer 64 and the second spacer 640 of the support seat 61. Thus, the first hammer 70 is driven by the first pin 67 and the second hammer 75 is driven by the second pin 68 respectively.

In addition, the first hammer 70 is formed with a first locking hole 71, and the second hammer 75 is formed with a second locking hole 76 located opposite to the first locking hole 71, so that the first hammer 70 and the second hammer 75 co-operate to drive the drive shaft 80 to rotate in the normal direction and the reverse direction.

The drive shaft 80 has a first end mounted in the support seat 61 of the striking portion 60 and formed with an engaging portion 85 engaged with the first hammer 70 and the second hammer 75 and a second end formed with a mounting portion 81 for mounting the socket. The engaging portion 85 of the drive shaft 80 has a first end formed with a first driven block 86 mounted in the first locking hole 71 of the first hammer 70, a second end formed with a second driven block 87 mounted in the second locking hole 76 of the second hammer 75, and a mediate portion formed with a connecting rib 88 located between and connected to the first driven block 86 and the second driven block 87 to reinforce the structural strength of the engaging portion 85 of the drive shaft 80.

In operation, after the compressed air enters the cylinder 51 of the pneumatic motor 50, the vane 52 and the rotor 55 are operated to rotate the toothed shaft 56 which rotates the support seat 61, so that the support seat 61 of the striking portion 60 is rotated in the normal direction and the reverse direction to move the first pin 67 and the second pin 68 to move the first hammer 70 and the second hammer 75 which are driven to strike the first driven block 86 and the second driven block 87 of the drive shaft 80 respectively, so as to drive the drive shaft 80 to rotate. Thus, the drive shaft 80 is rotated to rotate the socket mounted on the mounting portion 81 of the drive shaft 80 so as to drive and rotate a screw member, such as a bolt, nut or the like.

Accordingly, the locking strip 72 of the first hammer 70 and the locking strip 77 of the second hammer 75 increase the thickness of the first hammer 70 and the second hammer 75 respectively to reinforce the structural strength of the first hammer 70 and the second hammer 75, thereby preventing the first hammer 70 and the second hammer 75 from being broken due to vibration so as to increase the lifetime of the first hammer 70 and the second hammer 75. In addition, the first pin 67 is used to drive the first hammer 70 and the second pin 68 is used to drive the second hammer 75 respectively, so that each of the first pin 67 and the second pin 68 has a smaller length to increase the structural strength of the first pin 67 and the second pin 68, thereby preventing the first pin 67 and the second pin 68 from being broken due to a bending action so as to increase the lifetime of the first pin 67 and the second pin 68.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pneumatic wrench, comprising a striking portion including:

a support seat having a first side wall having an inner face formed with a first insertion hole for mounting a first pin and a second side wall opposite to the first side wall and having an inner face formed with a second insertion hole for mounting a second pin;

a first hammer mounted in the support seat and having a first side secured on the first pin and a second side formed with a locking strip inserted into and locked in the second insertion hole; and a second hammer mounted in the support seat and having a first side secured on the second pin and a second side formed with a locking strip inserted into and locked in the first insertion hole.

2. The pneumatic wrench in accordance with claim 1, wherein the first pin and the second pin are located diagonally opposite relative to each other.

3. The pneumatic wrench in accordance with claim 1, wherein the inner face of the first side wall of the support seat has a mediate portion formed with a first spacer mounted on the first pin, and the inner face of the second side wall of the support seat has a mediate portion formed with a second spacer mounted on the second pin.

4. The pneumatic wrench in accordance with claim 3, wherein the first insertion hole is extended through the first spacer.

5. The pneumatic wrench in accordance with claim 3, wherein the second insertion hole is extended through the second spacer.

6. The pneumatic wrench in accordance with claim 3, wherein the first pin is inserted into the first insertion hole of the support seat.

7. The pneumatic wrench in accordance with claim 3, wherein the second pin is inserted into the second insertion hole of the support seat.

8. The pneumatic wrench in accordance with claim 3, wherein the first hammer and the second hammer are separated by the first spacer and the second spacer of the support seat.

9. The pneumatic wrench in accordance with claim 1, wherein the first side of the first hammer is formed with a cavity mounted on the first pin.

10. The pneumatic wrench in accordance with claim 1, wherein the first side of the second hammer is formed with a cavity mounted on the second pin.

11. The pneumatic wrench in accordance with claim 1, wherein the first hammer is driven by the first pin and the second hammer is driven by the second pin respectively.

12. The pneumatic wrench in accordance with claim 1, further comprising a drive shaft having an end mounted in the support seat of the striking portion and formed with an engaging portion engaged with the first hammer and the second hammer.

13. The pneumatic wrench in accordance with claim 12, wherein the engaging portion of the drive shaft has a first end formed with a first driven block mounted in the first hammer, a second end formed with a second driven block mounted in the second hammer, and a mediate portion formed with a connecting rib located between and connected to the first driven block and the second driven block.

* * * * *